US006926553B2

(12) United States Patent
Wu

(10) Patent No.: US 6,926,553 B2
(45) Date of Patent: Aug. 9, 2005

(54) CABLE ASSEMBLY WITH IMPROVED GROUNDING MEANS

(75) Inventor: Jerry Wu, Irvine, CA (US)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 10/600,517

(22) Filed: Jun. 19, 2003

(65) Prior Publication Data

US 2004/0259420 A1 Dec. 23, 2004

(51) Int. Cl.[7] ..... H01R 12/24
(52) U.S. Cl. ..... 439/497; 439/701
(58) Field of Search ..... 439/497, 579, 439/610

(56) References Cited

U.S. PATENT DOCUMENTS 3,864,011 A * 2/1975 Huber ..... 439/472
4,826,443 A * 5/1989 Lockard ..... 439/101
4,993,968 A * 2/1991 Guletsky et al. ..... 439/492
5,417,590 A * 5/1995 Dechelette et al. ..... 439/607
5,456,618 A * 10/1995 Nakamura ..... 439/610
5,924,899 A 7/1999 Paagman
6,102,747 A 8/2000 Paagman
6,217,364 B1 4/2001 Miskin et al.
6,428,344 B1 * 8/2002 Reed ..... 439/455

* cited by examiner

*Primary Examiner*—Neil Abrams
(74) *Attorney, Agent, or Firm*—Wei Te Chung

(57) ABSTRACT

A cable assembly (1) for engaging a complementary connector includes an insulating housing (10), a number of circuit modules (20) received in the housing, and a two-piece cover (30) cooperating with the housing for retaining the circuit modules. Each circuit module includes a circuit board (22) accommodated in the housing, a number of coaxial cables (23) each including a conductive core (231) soldered on one side of the circuit board, and a grounding plate (24) attached to an opposite side of the circuit board and electrically connecting with a metal braid (232) covering the conductive core of each cable.

14 Claims, 9 Drawing Sheets

CABLE ASSEMBLY WITH IMPROVED GROUNDING MEANS

CROSS-REFERENCE TO RELATED APPLICATIONS

Subject matter of this patent application is related to U.S. Pat. No. 6,699,072, entitled "CABLE ASSEMBLY", filed on Dec. 10, 2002, U.S. Pat. No. 6,685,510, filed on Oct. 22, 2002 and entitled "ELECTRICAL CABLE CONNECTOR", all of which are invented by Jerry Wu and assigned to the same assignee as this application.

BACKGROUND OF THE INVENTION

1. Field of the Invention

The present invention generally relates to a cable assembly, and particularly to a cable assembly having a plurality of circuit boards for high speed signal transmission.

2. Description of Related Art

With the development of communication and computer technology, high density electrical connectors are desired to construct a plurality of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combine to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. Nos. 5,924,899 (the '899 patent) and 6,102,747 (the '747 patent), both issued to Paagman, each disclose a cable assembly. Referring to FIGS. 4*a*–4*c* and 5*a*–5*c* of the '899/'747 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite to the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bind the cables together, thereby increasing the cost of the production.

Hence, an improved cable assembly is highly desired to overcome the disadvantages of the related art.

BRIEF SUMMARY OF THE INVENTION

Accordingly, it is an object of the present invention to provide a cable assembly having strain relief means for substantially resisting a pulling force exerted on a cable thereof.

It is another object of the present invention to provide a cable assembly having a pluraity of singal-ended coaxial cable connecting to circuit boards thereof.

In order to achieve the above-mentioned objects, a cable assembly in accordance with the present invention for engaging with a complementary connector, comprises an insulating housing, a plurality of circuit modules received in the housing, and a two-piece cover cooperating with the housing for retaining the circuit modules. Each circuit module includes a circuit board accommodated in the housing, a number of single-ended coaxial cables mechanically and electrically connecting with the circuit board, a grounding plate attached to the circuit board, and a cable clamp for clamping the cables. Each single-ended coaxial cable comprises a conductive core soldered to the circuit board and a braid surrounding the conductive core and soldering with the grounding plate.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
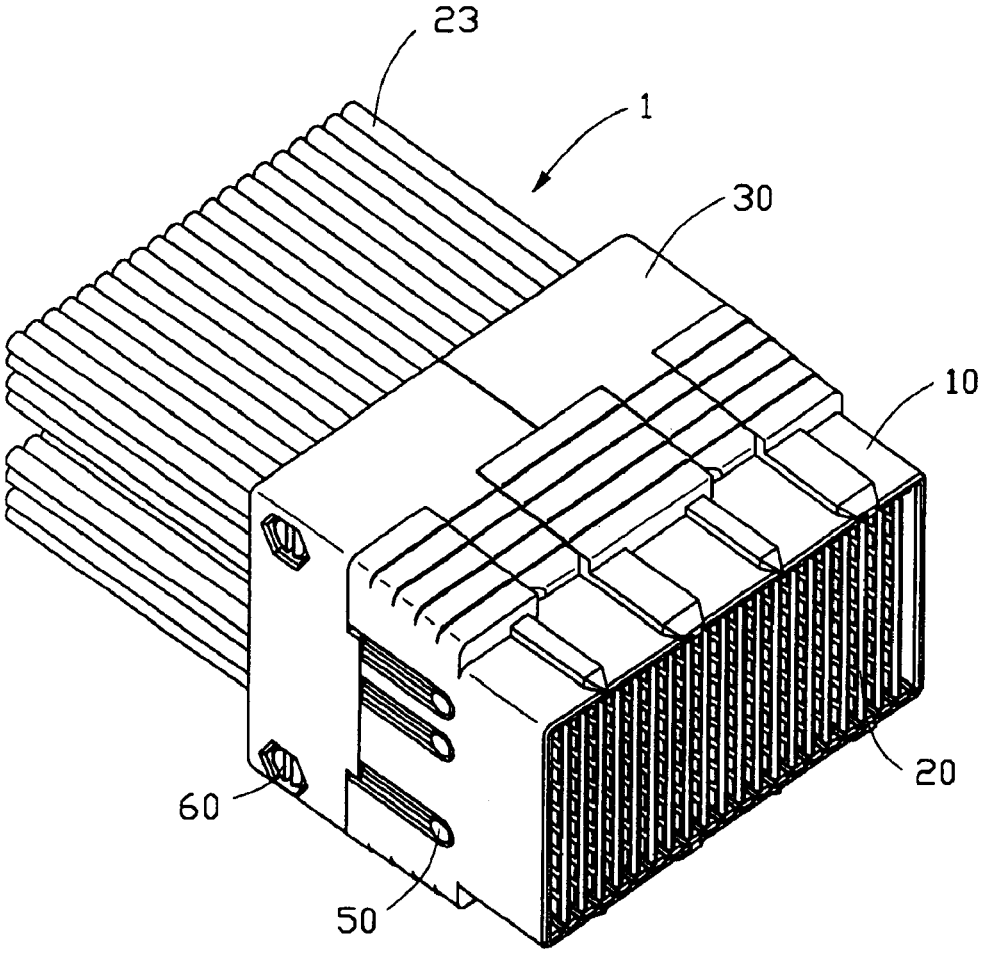
FIG. 1 is a perspective view of a cable assembly in accordance with the present invention.

Reference will now be made to the drawing figures to describe the present invention in detail.

Figure 2:
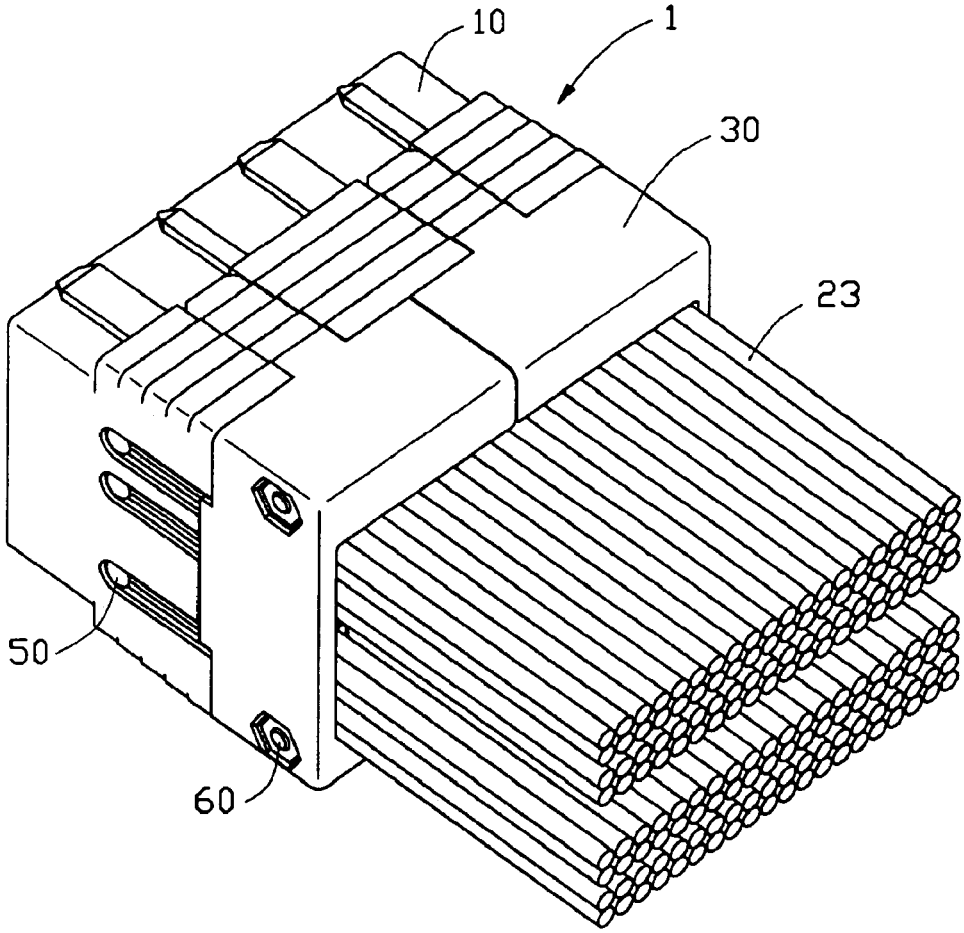
FIG. 2 is another perspective view of the cable assembly.

With reference to FIGS. 1 and 2, a cable assembly 1 in accordance with the present invention comprises a front insulating housing 10, a plurality of circuit modules 20 received in the front insulating housing 10, and a two-piece rear cover 30 together engaged with the front insulating housing 10 for retaining the circuit modules 20.

Figure 3:
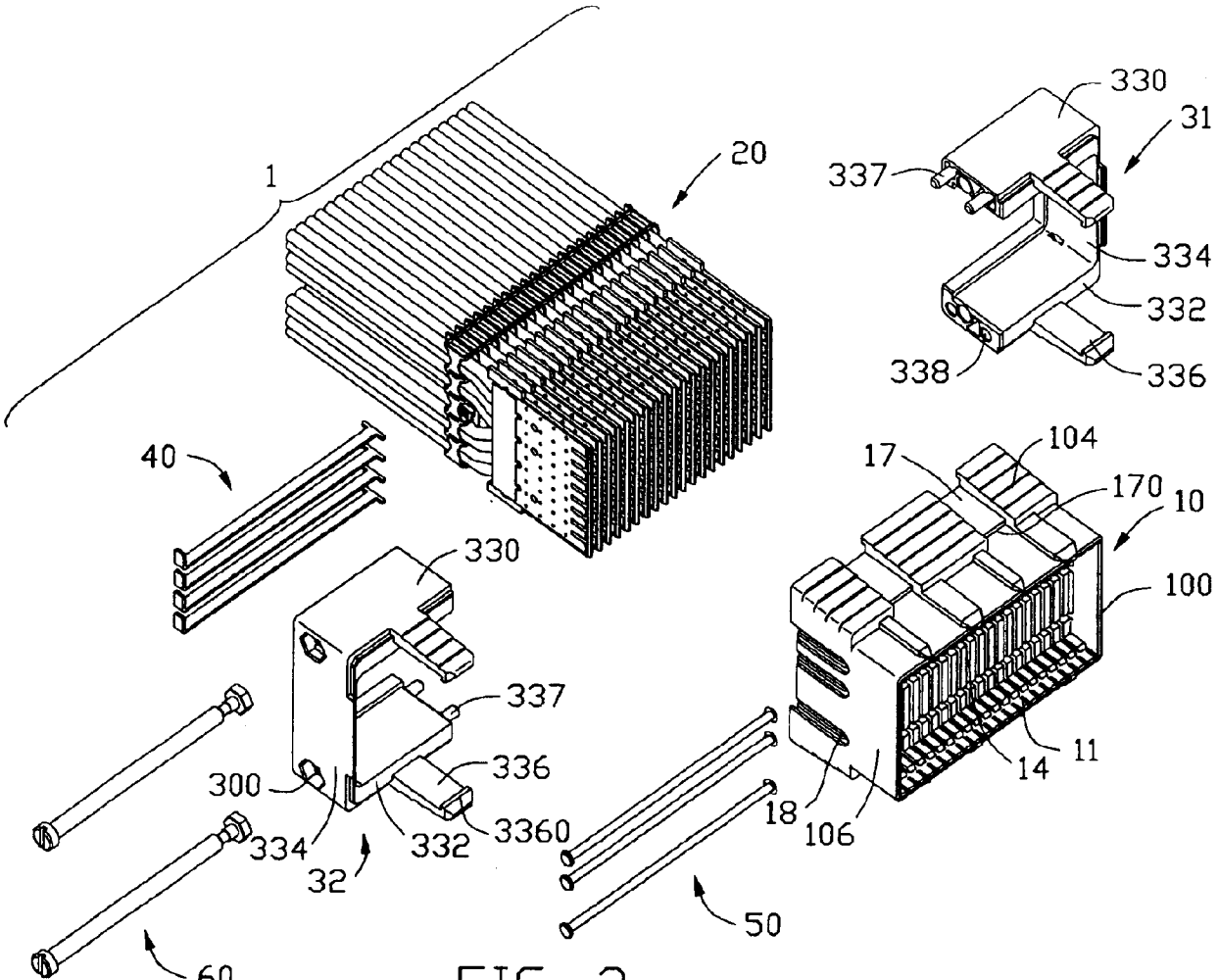
FIG. 3 is an exploded, perspective view of the cable assembly.
Figure 4:
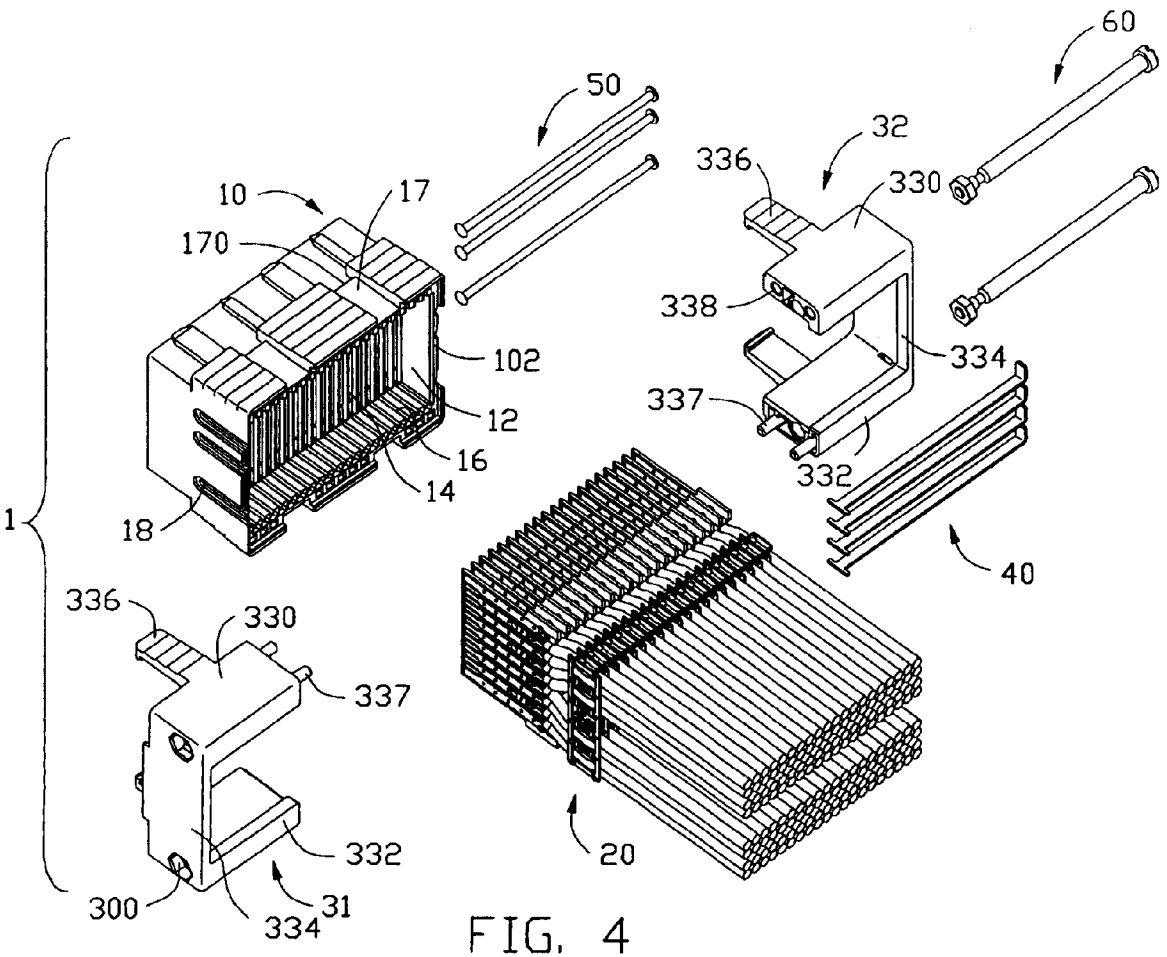
FIG. 4 is another exploded, perspective view of the cable assembly.

Referring to FIGS. 3 and 4, the front housing 10 is generally in a rectangular shape. The housing 10 has a front mating port 11 in a front mating face 100 thereof which faces a complementary connector (not shown) and a rear chamber 12 in a rear face 102 thereof. The housing 10 defines a plurality of parallel channels 14 extending in a front-to-back direction communicating with the front mating port 11 and the rear chamber 12 and a plurality of grooves 16 which are aligned with the channels 14. The housing 10 further defines a plurality of recesses 17 respectively in a top face 104 and a bottom face (not labeled) and a plurality of depressions 170 recessed downwardly from the corresponding recesses 17. An aperture 18 is defined through opposite side faces 106 of the housing 10 in a direction substantially perpendicular to the extending direction of the channels 14.

Continuing to FIGS. 3 and 4, and in conjunction with FIGS. 1 and 2, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 onto the housing 10 over the circuit modules 20. Understandably, the first and the second halves 31, 32 can be integrally formed with each other before assembling to the housing 10, if desired.

The circuit modules 20 are identical with each other in structure thereof and an exemplary one is shown in FIGS. 5–8. Each circuit module 20 comprises a circuit board 22 and a plurality of single-ended coaxial cables 23 electrically and mechanically connecting with the circuit board 22. The circuit board 22 includes a dielectric substrate made of conventional circuit board substrate material, a plurality of conductive signal traces (not labeled) on one side of the substrate for providing electrical paths through the cable assembly 1 and a plurality of grounding traces (not labeled) on both sides of the substrate for grounding purpose. Each circuit board 22 comprises a front edge portion 220 provided for engaging with the complementary mating connector and a rear edge portion 224 to which the cables 23 are mechanically connected. A through hole 222 is provided on the circuit board 22 which aligns with the aperture 18 of the housing 10 and a plurality of cavities 226 are defined adjacent to the rear edge portion 224.

The single-ended coaxial cables 23 of each circuit module 20 are arranged in a common plane. As well known, each single-ended coaxial cable 23 comprises a conductive core 231 surrounded by a dielectric layer (not labeled), a metal braid 232 outside the dielectric layer, and a jacket 233 at the outmost side of the cable 23. At a distal end of each coaxial cable 23, a length of dielectric layer is stripped to expose a corresponding length of conductive core 231. The bare conductive core 231 is soldered to the signal trace on the circuit board 22 from one side thereof. As can be best seen in FIGS. 6 and 8, in the preferred embodiment, the cables 23 of each circuit module 20 are separated into two groups, each group comprising two pairs of coaxial cables 23 with a gap 27 being defined therebetween.

With reference to FIGS. 5–8, the circuit module 20 also comprises a grounding plate 24 and a cable clamp 25 adapted for being applied to the cables 23. The grounding plate 24 is preferably a copper tape and is formed with a plurality of tabs 242 positioned at a periphery thereof. The grounding plate 24 is attached to the circuit board 22 from a side opposite to the conductive cores 231 of the cables 23 with the tabs 242 retained in the cavities 226 of the circuit board 22 to thereby secure the grounding plate 24 thereon.

The cable clamp 25 includes a first section 251 and a second section 252 both are stamped and formed from metal tapes. The first section 251 defines a plurality of rooms 253 and forms a plurality of bridges 254 between adjacent rooms 253. Each bridge 254 defines a pair of openings 255 at opposite ends thereof. The second section 252 includes a body portion 256 and two rows of tails 257 upwardly extending from two opposite sides of the body portion 256. The first and second sections 251, 252 clamp ends of the cables 23 from opposite sides with the tails 257 of the second section 252 being locked in corresponding openings 255 of the first section 251. The ends of the cables 23 are depressed by the body portion 256 of the second section 252 such that they are partially pressed into corresponding rooms 253 of the first section 251. The first and second sections 251, 252 further define a plurality of through holes 266 which are aligned with corresponding gaps 27 between adjacent pairs of cables 23 of a same group.

Figure 5:
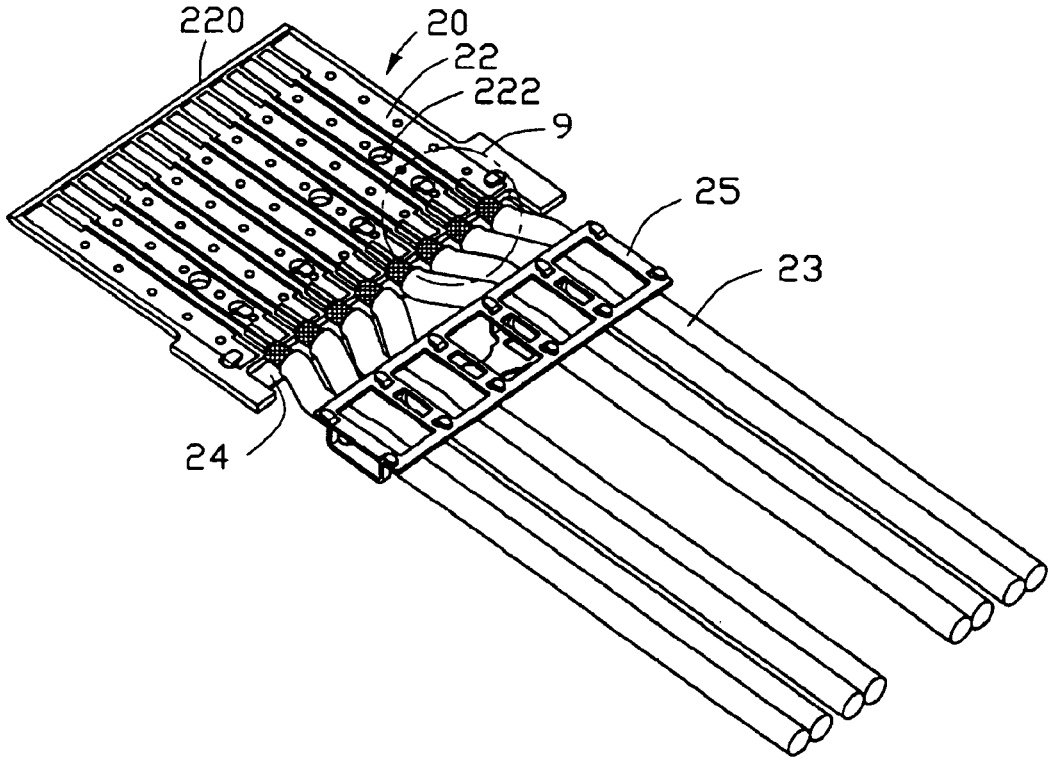
FIG. 5 is a perspective view of a circuit module.
Figure 6:
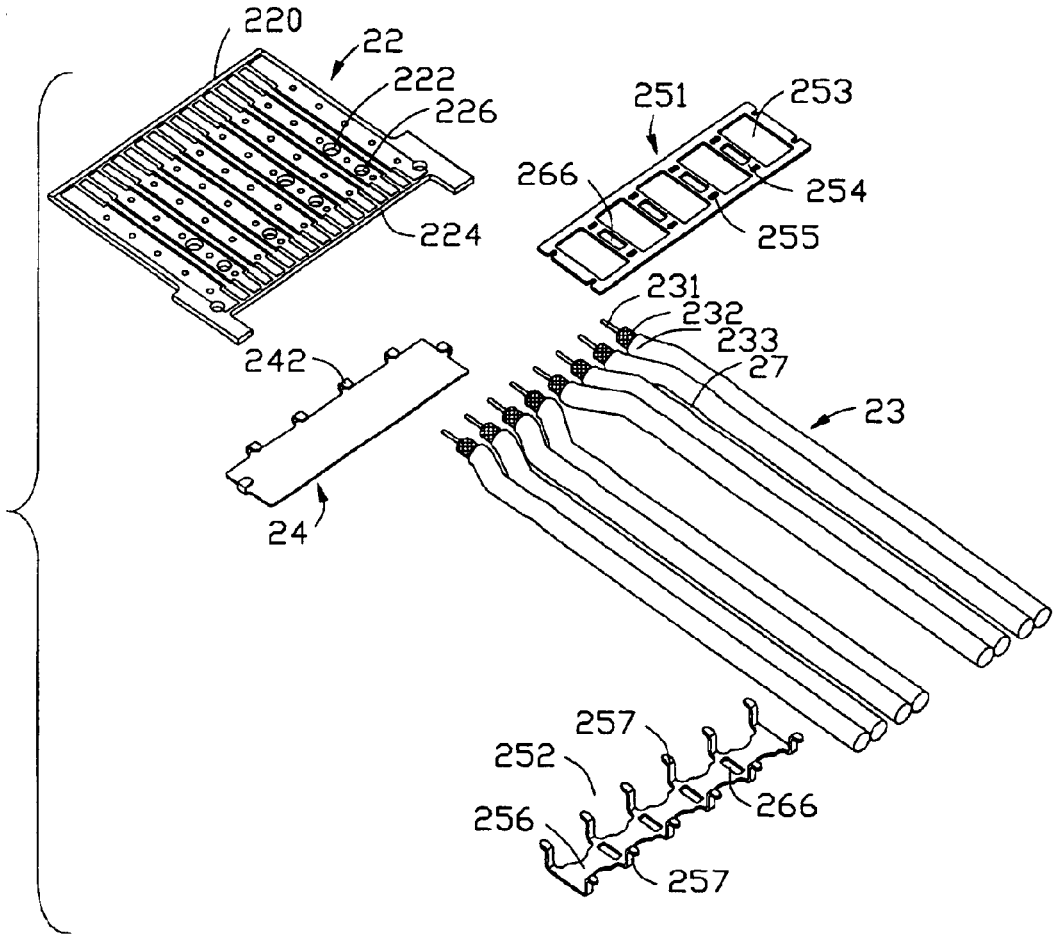
FIG. 6 is an exploded, perspective view of the circuit module shown in FIG. 5.
Figure 7:
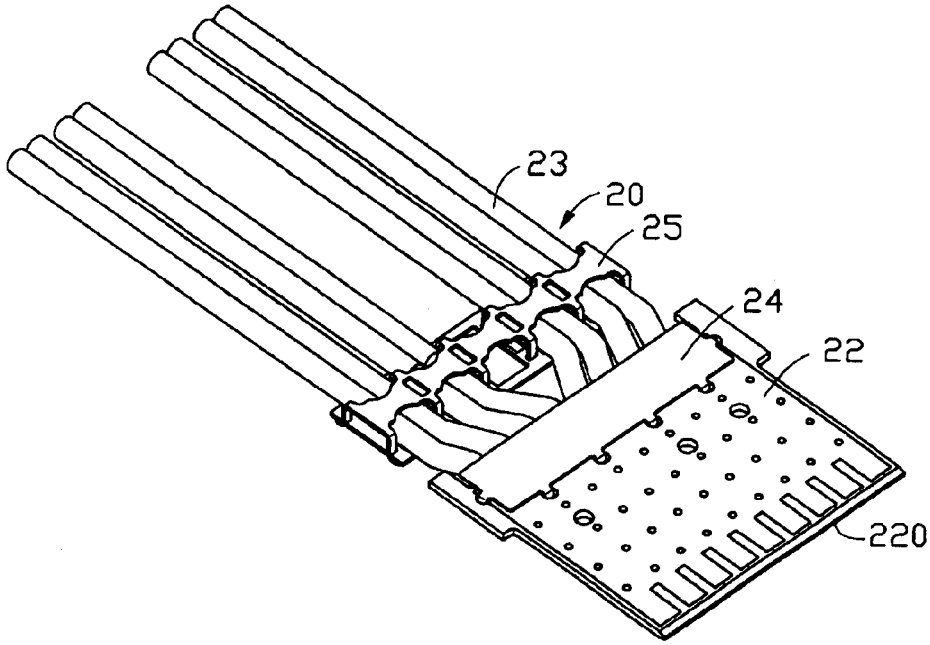
FIG. 7 is another perspective view of the circuit module.
Figure 8:
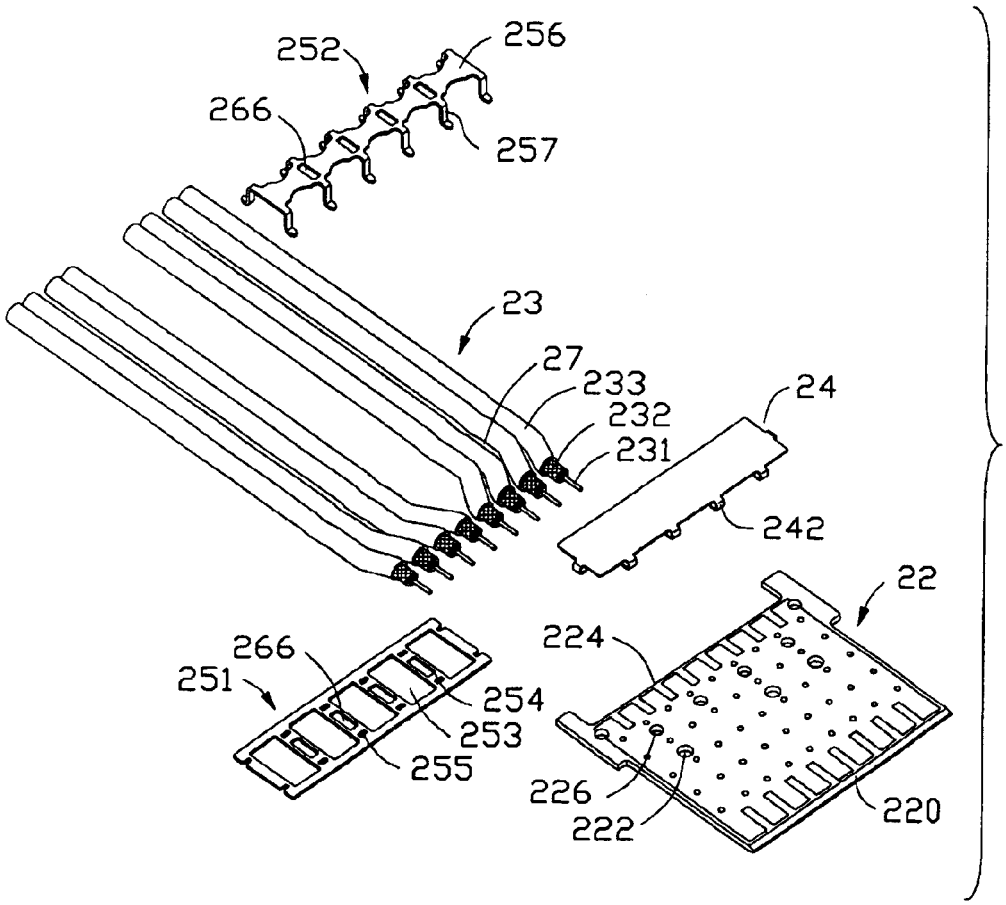
FIG. 8 is an exploded, perspective view of the circuit module shown in FIG. 7.
Figure 9:
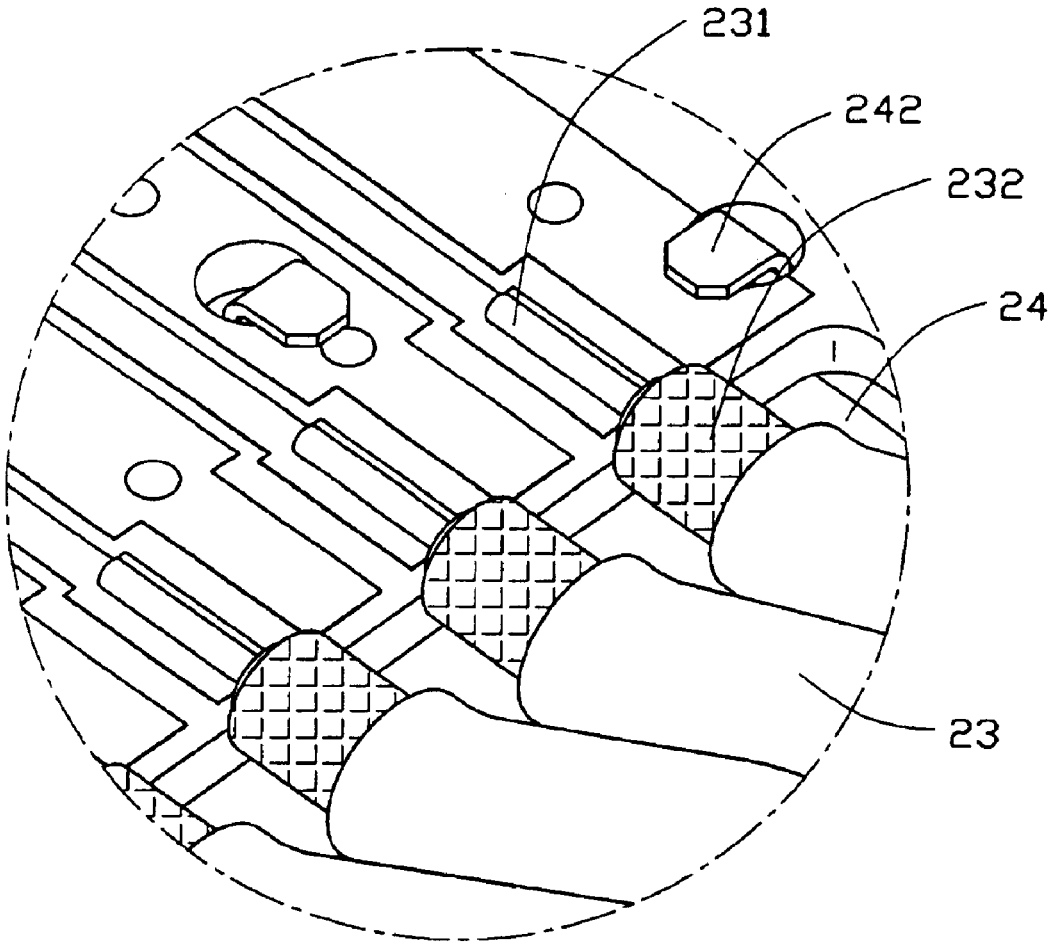
FIG. 9 is a partially enlarged view of the circuit module shown in FIG. 5 showing braids of the cables being soldered with a ground plate.

Particularly referring to FIG. 9 in conjunction with FIGS. 5–6, an end of each coaxial cable 23 is stripped to further expose a length of braid 232, the exposed braid 232 being soldered to the grounding plate 24 attached on an opposite side of the circuit board 22 to provide not only a grounding function but a strain relief function for the cable 23.

In assembly, referring to FIGS. 1–6, the circuit modules 20 are inserted into the channels 14 of the housing 10 from the rear face 102 with the circuit boards 22 being substantially retained in the grooves 16. First fastening elements 40 are inserted into the through-holes 266 of the cable clamps 25 for locking the circuit modules 20 together for strain relief purpose. A second fastening element 50 is inserted into holes 222 defined in the circuit boards 22 through the aperture 18 of the housing 10. The second fastening element 50 is further fastened to the housing 10 for keeping the circuit modules 20 in their original positions rather than be pushed back when the cable assembly 1 mates with the complementary connector, thereby stably retaining the circuit modules 20 in the housing 10.

The first and second halves 31, 32 of the cover 30 are assembled to the housing 10 with the projections 3360 of the latches 336 mechanically engage the depressions 170 of the recesses 17. At the same time, the first and second halves 31, 32 are connected by an interference engagement between the dowel pins 337 and the corresponding recesses 338. A third fastening element 60 is inserted into the bore 300 of the cover 30 for retaining the circuit modules 20 in the cover 30.

It is noted that since the circuit modules 20 are stably retained by the front housing 10 and the rear cover 30 via the second and third fastening elements 50, 60, a reliable electrical engagement is ensured between the cable assembly 1 and the complementary connector. It is also noted that the cables 23 are clamped by the cable clamps 25, more importantly, the cable clamps 25 are locked together via the first fastening element 40, whereby a pulling force exerted on the cables 23 can be substantially released.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly comprising:

an insulating housing defining a plurality of channels;

a cover assembled to the insulating housing and latchably engaged with the insulating housing; and a plurality of circuit modules juxtaposed in the housing, each circuit module comprising a circuit board received in a corresponding channel of the housing, a plurality of coaxial cables connecting to the circuit board, a cable clamp binding the cables together, and a grounding plate, each coaxial cable being electrically connected with the grounding plate; wherein the each circuit board defines a plurality of cavities and the grounding plate has a plurality of tabs retained in corresponding cavities of the circuit board.

2. The cable assembly as described in claim 1, wherein each coaxial cable comprises a conductive core and a metal braid surrounding the conductive core, and wherein the conductive core is soldered to the circuit board, and the metal braid is soldered with the grounding plate.

3. The cable assembly as described in claim 1, wherein each cable clamp comprises a first and a second stamped metallic sections clamping the coaxial cables from opposite sides.

4. The cable assembly as described claim 3, wherein the first section defines a plurality of rooms and the coaxial cables are depressed into the rooms by the second section.

5. The cable assembly as described in claim 1, further comprising a fastening element, and wherein each cable clamp defines at least one through hole for insertion of the fastening element.

6. The cable assembly as claimed in claim 1, wherein the cover comprises a first and a second halves assembled to each other in a direction perpendicular to an extending direction of the coaxial cables.

7. The cable assembly as claimed in claim 6, wherein the first and the second halves of the cover latch with the insulating housing in the extending direction of the coaxial cables.

8. The cable assembly as claimed in claim 1, wherein the cover is made of insulative material.

9. A cable assembly comprising;

an insulating housing comprising a plurality of channels and an aperture extending along a direction perpendicular to the channels;

a plurality of circuit modules each comprising a circuit board being retained in a corresponding channel of the housing and defining therethrough a hole aligned with the aperture of the housing, a plurality of cables electrically connecting to one side of the circuit board, and a grounding plate attached to an opposite side of the circuit board, each cable comprising a metal braid electrically soldered with grounding plate;

a cover comprising first and second halves jointed together and being attached to the housing, the cover defining a bore extending through the first and second halves; and first and second fastening elements respectively inserted into the holes of the circuit boards through the aperture of the housing and the bore of the cover for retaining the circuit modules relative to the housing.

10. The cable assembly as described in claim 9, wherein each circuit board defines a plurality of cavities and the grounding plate has a plurality of tabs retained in corresponding cavities of the circuit board.

11. The cable assembly as described in claim 10, wherein each circuit module further comprises a cable clamp binding the cables together.

12. The cable assembly as described in claim 11, further comprising a third fastening element, and wherein the cable clamp defines a through hole therein for providing the third fastening element inserting thereinto.

13. A cable assembly comprising:

an insulative housing;

a plurality of juxtaposed printed circuit boards disposed in the housing, each of said printed circuit boards defining opposite first and second surfaces and a cutout in a rear edge section thereof;

a plurality of juxtaposed coaxial cables located along said rear edge section of each of said printed circuit boards, each of said cables extending along a first direction parallel to the corresponding printed circuit board while substantially perpendicular to a rear edge of the corresponding printed circuit board; and a grounding plate fixedly positioned on the second surface of said each of the printed circuit boards around the corresponding rear edge section, said each of said cables defining an inner conductor, an inner insulator, a metallic braiding and an outer insulator concentrically arranged with one another in outward sequence, the inner conductor soldered on the first surface while the braiding located in said cutout of a corresponding printed circuit board and mechanically and electrically connected to the grounding plate.

14. The assembly as described in claim 13, wherein the braiding of each of said cables engages the grounding plate located beside said cutout in a second direction perpendicular to said first direction.

* * * * *